US008240665B2

(12) United States Patent
Fujita

(10) Patent No.: US 8,240,665 B2
(45) Date of Patent: Aug. 14, 2012

(54) SHEET CONVEYING APPARATUS AND IMAGE FORMING APPARATUS

(75) Inventor: Takashi Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/962,955

(22) Filed: Dec. 8, 2010

(65) Prior Publication Data

US 2011/0156341 A1 Jun. 30, 2011

(30) Foreign Application Priority Data

Dec. 28, 2009 (JP) ..... 2009-298432

(51) Int. Cl.
*B65H 7/02* (2006.01)

(52) U.S. Cl. ..... 271/226; 271/228

(58) Field of Classification Search ..... 271/264, 271/272, 273, 274, 226, 228, 251
See application file for complete search history.

(56) References Cited

U.S. PATENT DOCUMENTS

| | | | | |
|---|---|---|---|---|
| 4,438,918 | A * | 3/1984 | Ito et al. | 271/251 |
| 4,909,500 | A * | 3/1990 | Grutzmacher et al. | 271/112 |
| 5,984,302 | A * | 11/1999 | Garrone | 271/227 |
| 6,055,407 | A * | 4/2000 | Inoue et al. | 399/381 |
| 6,059,284 | A * | 5/2000 | Wolf et al. | 271/227 |
| 6,102,391 | A * | 8/2000 | Malick et al. | 271/225 |
| 6,241,242 | B1 * | 6/2001 | Munro | 271/252 |
| 6,409,043 | B1 | 6/2002 | Fujita et al. | |
| 6,771,928 | B2 | 8/2004 | Fujita | |
| 7,127,186 | B2 | 10/2006 | Fujita et al. | |
| 7,416,182 | B2 * | 8/2008 | Nishida et al. | 271/228 |
| 7,549,629 | B2 | 6/2009 | Tateishi et al. | |
| 7,748,697 | B2 | 7/2010 | Fujita et al. | |
| 2011/0158724 | A1 | 6/2011 | Fujita | |

FOREIGN PATENT DOCUMENTS

| | | |
|---|---|---|
| JP | 2002-308474 | 10/2002 |

* cited by examiner

*Primary Examiner* — Kaitlin Joerger
(74) *Attorney, Agent, or Firm* — Fitzpatrick, Cella, Harper & Scinto

(57) ABSTRACT

The apparatus of the present invention is provided with: a spherical conveying rotation member that is driven to rotate in a desired direction; a driven rotation member disposed above the conveying rotation member so as to be pressed onto an upper portion of the conveying rotation member so that the driven rotation member nips a sheet in cooperation with the conveying rotation member to convey the sheet; two driving rollers press with the conveying rotation member so as to drive the conveying rotation member to rotate; and a driven roller that is made in press-contact with the conveying rotation member to be driven together therewith, and in this structure, the two driving rollers and the driven roller are disposed below the conveying rotation member so as to support the conveying rotation member by the two driving rollers and the driven roller from below.

16 Claims, 14 Drawing Sheets

SHEET CONVEYING APPARATUS AND IMAGE FORMING APPARATUS

BACKGROUND OF THE INVENTION

1. Field of the Invention

The present invention relates to a sheet conveying apparatus provided with a spherical conveying rotation member and a driven rotation member pressed with the conveying rotation member so that a sheet is nipped to be conveyed by these members, and an image forming apparatus provided with such a sheet conveying apparatus.

2. Description of the Related Art

In general, image forming apparatuses, such as those of an electrophotographic system, an offset printing system, and an inkjet system, have been known. In recent years, in these image forming apparatuses, there have been increasing demands for a technique, upon conveying a sheet, the posture of the sheet is corrected with high precision. Normally, by correcting a skew feeding of a sheet and a positional deviation in the width direction thereof, the posture of the sheet is corrected so that positions of the sheet and an image to be formed are adjusted. Moreover, a technique by which the posture of a sheet is corrected so that a conveying defect, such as a jam, is avoided, and a technique by which the sheet posture is corrected so that the sheet edge is avoided from being made in contact with a roller that is a consumable product at the same position, thereby prolonging the service life of the consumable products against damages, have been proposed. In another technique, the posture of a sheet is corrected so as to convey the sheet to a post processing device for a book-binding process.

Moreover, a structure has been proposed in which a reference guide and a spherical conveying ball that carries out a pulling-over action to the reference guide are installed so as to correct a positional deviation in the width direction of a sheet such as copy paper (see Japanese Patent Application Laid-Open No. 2002-308474). In Japanese Patent Application Laid-Open No. 2002-308474, two rotation rolls are disposed on the upstream side of the conveying ball and at a position with an angle of 90° relative to the width direction so as to be pressed with the equator of the conveying ball so that by changing the pressing force of the rotation rolls to the conveying ball, the rotation direction of the conveying ball is altered. The rotation rolls are driven to rotate by a rotation driving motor, and in order to change the pressing force of the rotation rolls, a pressing force variable motor is installed in a separate manner.

However, in the above-mentioned conventional structure, since the conveying ball is pressed by the rotation rolls to change the rotating direction, the equator portion of the conveying ball needs to be supported by a ball supporting member so as not to move the conveying ball by the pressing force of the rotation rolls. Since the conveying ball is pressed onto the ball supporting member by the pressing force of the rotation rolls, a frictional force is changed between the conveying ball and the ball supporting member depending on the pressing force of the rotation rolls. In the case when the frictional force between the conveying ball and the ball supporting member is changed in this manner, the rotation of the conveying ball becomes unstable. Moreover, when the pressing force of the rotation rolls is large, the frictional force between the conveying ball and the ball supporting member becomes excessively large to sometimes cause a difficulty in smoothly altering the rotation direction of the conveying ball.

Therefore, the objective of the present invention is to provide a sheet conveying apparatus and an image forming apparatus that can carry out a stable frictional driving operation on the conveying rotation member with a simple structure so that the posture of the sheet can be easily corrected.

SUMMARY OF THE INVENTION

The present invention provides a sheet conveying apparatus including: a spherical conveying rotation member driven to rotate in a desired direction; a driven rotation member disposed above the conveying rotation member so as to be pressed onto an upper portion of the conveying rotation member so that the driven rotation member nips a sheet in cooperation with the conveying rotation member to convey the sheet; two driving rollers pressed with the conveying rotation member so as to drive the conveying rotation member to rotate; and a driven roller pressed with the conveying rotation member to be driven together therewith, and in this structure, the two driving rollers and the driven roller are disposed below the conveying rotation member so as to support the conveying rotation member by the two driving rollers and the driven roller from below.

According to the present invention, since the conveying rotation member is supported by the two driving rollers and the driven roller from below so that the conveying rotation member is effectively pressed with the driving rollers, and fluctuations in a frictional force between the two driving rollers, as well as the driven roller, and the conveying rotation member can be reduced. Therefore, since the rotating speed and rotation direction of the conveying rotation member are stabilized, the sheet can be conveyed stably at a desired conveying speed and a desired direction.

Further features of the present invention will become apparent from the following description of exemplary embodiments with reference to the attached drawings.

BRIEF DESCRIPTION OF THE DRAWINGS

FIG. 2A is a front view of the registration portion and FIG. 2B is a perspective view of the registration portion;

FIG. 3A is a perspective view illustrating an essential portion of the sheet posture correcting portion and FIG. 3B is an explanatory view that illustrates a ball conveying mechanism;

FIG. 4A is a perspective view illustrating an essential portion of the ball conveying mechanism and FIG. 4B is an explanatory view illustrating an essential portion of the ball conveying mechanism;

FIG. 10A is a drawing that illustrates a state in which a sheet is pulled over to the right side relative to a target position and FIG. 10B is a drawing that illustrates a state in which a sheet is pulled over to the left side relative to the target position;

FIG. 11A is a drawing that illustrates a skew feeding state of a sheet and FIG. 11B is a drawing that illustrates a state upon completion of the sheet posture controlling process;

FIG. 12A is a drawing that illustrates a conveying position that depends on a sheet size and FIG. 12B is a drawing that illustrates a conveying position at the time of an alignment correction;

FIG. 14A is an explanatory drawing of a ball conveying mechanism and FIG. 14B is an explanatory drawing of a driven roller.

DESCRIPTION OF THE EMBODIMENTS

Figure 1:
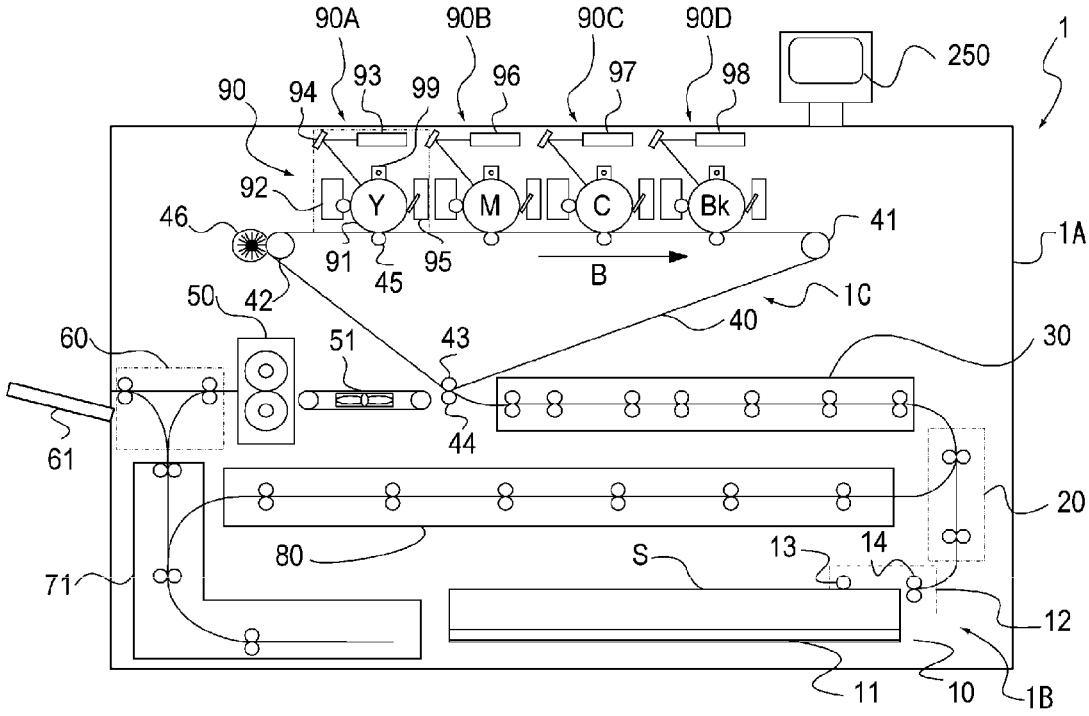
FIG. 1 is a view which illustrates a schematic configuration of a color image forming apparatus that is one example of an image forming apparatus according to an embodiment of the present invention.

FIG. 1 is a view that illustrates a schematic structure of a color image forming apparatus of one example of the image forming apparatus according to an embodiment of the present invention. In FIG. 1, reference numeral 1 represents an image forming apparatus and 1A represents an image forming apparatus main body (hereinafter, referred to as an apparatus main body). The apparatus main body 1A is provided with an image forming section 90 that forms an image on a sheet S, and a sheet supplying device 1B that supplies the sheet S. Moreover, the apparatus main body 1A is provided with a registration portion 30 that serves as a sheet conveying device for conveying the sheet S supplied from the sheet supplying device 1B to an image forming section 90 disposed on the downstream side in a sheet conveying direction. Furthermore, on the upper surface of the apparatus main body 1A, an operation portion 250, which allows the user to carry out various inputting operations/setting operations on the apparatus main body 1A, is connected.

The image forming section 90 has image forming portions 90A to 90D of yellow (Y), magenta (M), cyan (C) and black (Bk), and a transfer portion 1C. Moreover, each of the image forming portions 90A to 90D include a photosensitive drum 91, an exposing device 93, a development device 92, a primary transfer roller 45, a photosensitive drum cleaner 95, a charging device 90, and the like. Additionally, colors formed by the respective image forming portions 90A to 90D are not limited to these four colors, and the aligning order of the colors is not limited to this order.

The transfer portion 1C transfers a toner image onto a conveyed sheet S. The transfer portion 1C is provided with an intermediate transfer belt 40 that is passed over rollers, such as a driving roller 42, a tension roller 41, a secondary transfer inner roller 43, and driven to be conveyed in a direction of arrow B in the Figure. In this structure, a toner image, formed on the photosensitive drum, is transferred on the intermediate transfer belt 40 by a predetermined applied pressure and an electrostatic load bias given by the primary transfer roller 45. Moreover, in a secondary transfer portion formed by the secondary transfer inner roller 43 and a secondary transfer outer roller 44 that are virtually opposed to each other, an unfixed image is attracted onto the sheet S by applying a predetermined applied pressure and an electrostatic load bias thereto.

The sheet supplying device 1B is provided with a sheet storage portion 10 which is drawably attached to the apparatus main body 1A by slide rails, not illustrated, and a sheet feeding portion 12 that feeds sheets S housed in the sheet storage portion 10. The sheet storage portion 10 is provided with a sheet feed lifter plate 11 that presses sheets S loaded therein onto the sheet feeding portion 12. Additionally, as the sheet supplying device 1B, a structure is adopted in which the uppermost sheet is picked up by the sheet feeding portion 12 and sent to the downstream side; however, an air sheet feed system may be adopted in which a sheet is sucked by air and sent. The sheet feeding portion 12 is provided with sheet feeding rollers 13, and the uppermost sheet S is picked up by the sheet feeding rollers 13 so that the sheet S is sent sheet by sheet. In the case when a plurality of sheets S are picked up simultaneously, the sheets are separated sheet by sheet by using paired separation conveying rollers 14, and conveyed.

Upon forming an image in the image forming apparatus 1 having this structure, first, the surface of the photosensitive drum 91 is preliminarily charged evenly, by a charger 99. Thereafter, onto the photosensitive drum 91 rotating in an arrow direction, an exposing device 93 emits light based on an image information signal transmitted thereto, and the light is irradiated via a reflection member 94 or the like, so that an latent image is formed on the surface of the photosensitive drum. In this case, transfer residual toner slightly remaining on the photosensitive drum 91 is collected by the photosensitive drum cleaner 95, and again prepared for the next image forming process.

A toner developing process is carried out on the electrostatic latent image thus formed on the photosensitive drum 91 by the developing device 92 so that a toner image is formed on the photosensitive drum. Thereafter, predetermined applied pressure and electrostatic load bias are applied by the primary transfer roller 45 so that the toner image on the photosensitive drum is transferred onto the intermediate transfer belt 40. The image forming processes by the respective image forming portions 90A to 90D of Y, M, C and Bk, of the image forming section 90 are carried out in such a timing as to superpose a toner image onto the toner image on the upstream side that has been primarily transferred on the intermediate transfer belt 40. As a result, a full-color toner image is finally formed on the intermediate transfer belt 40.

Moreover, a sheet S is sent from the sheet storage portion 10 by the sheet feeding portion 12 in the same timing as the image formation of the image forming section 90, and the sheet S is then allowed to pass through the conveying portion 20, and conveyed to the registration portion 30. After having been subjected to an inclined-proceed correction process of the sheet S and a positioning process of the side edges in the width direction of the sheet S in the registration portion 30, the sheet S is conveyed to a secondary transferring portion formed by the secondary transfer inner roller 43 and the secondary transfer outer roller 44 that are virtually opposed to each other. Thereafter, by applying predetermined applied pressure and electrostatic load bias thereto at the secondary transferring portion in the secondary transferring portion, the full-color toner image is secondarily transferred onto the sheet S.

Next, the sheet S on which the toner image has been secondarily transferred is conveyed to a fixing device 50 by a pre-fixing conveying portion 51. In the fixing portion 50, by applying a predetermined pressure by virtually opposed rollers or belts, and heat by a heat source, in general, such as a heater, the toner is fused and fixed onto the sheet S.

Next, the sheet S, which has the fixed image thus obtained is discharged onto a discharging tray 61 as it is by a branch-off conveying device 60. In the case when images are formed on both of the sides of the sheet S, it is then subjected to a path switching process by a conveying path switching member 63 capable of being switched, and conveyed to a reverse conveying device 80 forming a re-conveying portion by a branch-off conveying device 71.

When conveyed to the reverse conveying device in this manner, the sheet S is then joined to the sheet of the succeeding job conveyed from the sheet supplying device 1B in a conveying portion 20, in the same timing as each other, and sent to a secondary transfer portion. Since the image forming processes is the same as those carried out on the first surface, the description thereof will be omitted. Thus, a toner image is transferred on the back surface of the sheet S in the secondary transfer portion, and the toner image is then fixed. After the toner image has been fixed in this manner, the sheet S is discharged out of the apparatus main body 1A, and stacked on the discharging tray 61.

Figure 2A:
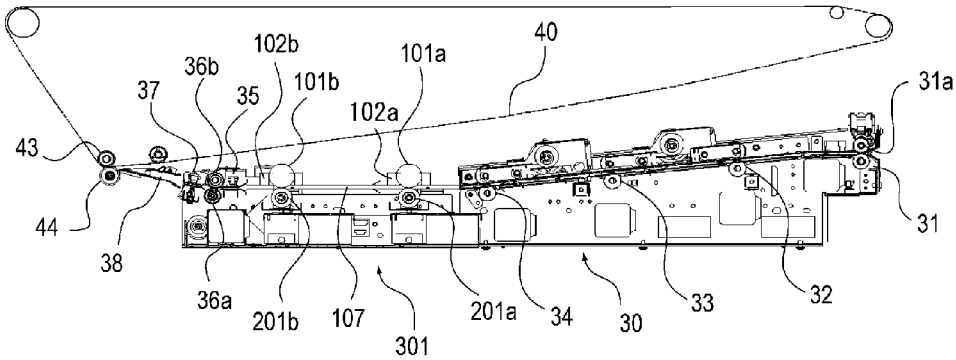
FIGS. 2A and 2B are views which illustrate a schematic configuration of a registration portion.
Figure 2B:
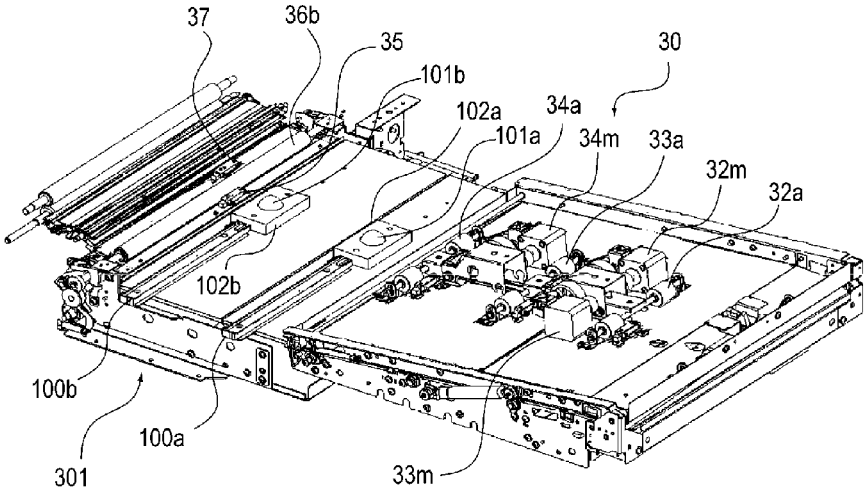

The description of the registration portion 30 will be made in detail in the following. As illustrated in FIGS. 2A and 2B, the registration portion 30 is provided with conveying rollers 31, 32, and 34 that are successively disposed from the upstream side toward the downstream side in a sheet conveying direction (hereinafter, referred to as a conveying direction). Moreover, the registration portion 30 is provided with a sheet posture correcting portion 301 disposed on the downstream in the conveying direction relative to the conveying roller 34. These conveying rollers 31, 32, 33 and 34 are driven to rotate by a driving source, not illustrated. Idler rollers 31*a*, 32*a*, 33*a* and 34*a*, opposed to the respective conveying rollers, are disposed above the conveying rollers 31, 32, 33 and 34. Pressure releasing motors 32*m*, 33*m* and 34*m* are connected to the idler rollers 32*a*, 33*a* and 34*a* through links, not illustrated, so that the idler rollers 32*a*, 33*a* and 34*a* are designed so as to be separatably made in contact with the conveying rollers 32, 33 and 34.

Between the sheet posture correcting portion 301 and a pair of rollers 43, 44 of the transfer portion 1C of the image forming section 90, a sheet detection sensor 35 serving as a sheet detection portion, a pair of registration rollers 36*a* and 36*b*, and a sheet detection sensor 37 are successively disposed. The pair of registration rollers 36*a* and 36*b* are composed of a registration driving roller 36*a* and a registration driven roller 36*b*.

Figure 3A:
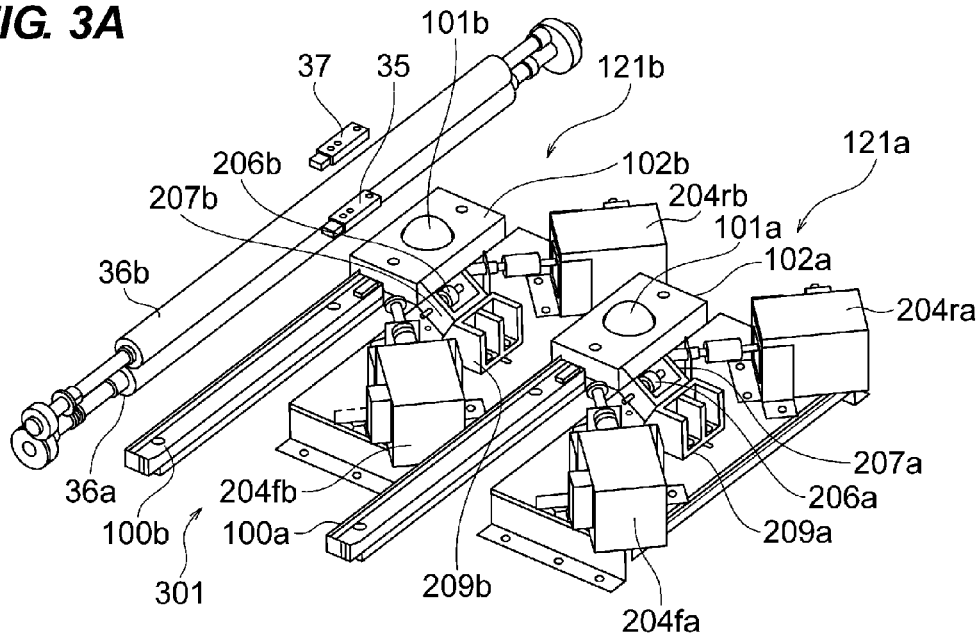
FIGS. 3A and 3B are views which illustrate a schematic configuration of a sheet posture correcting portion according to a second embodiment of the present invention.

The description of the sheet posture correcting portion 301 will be made in detail in the following. As illustrated in FIG. 3A, the sheet posture correcting portion 301 is provided with two ball conveying mechanisms 121*a* and 121*b* serving as two conveying portions. The ball conveying mechanisms 121*a* and 121*b* are designed so as to oblique-feed the sheet S in a desired direction relative to the conveying direction, and disposed along the conveying direction on the upstream side in the conveying direction of the image forming section 90. The ball conveying mechanism 121*a* and the ball conveying mechanism 121*b* are made of the same members.

The sheet posture correcting portion 301 is equipped with CISs 100*a* and 100*b* serving as two side end position detection portions, each of which detects each of side end positions in the width direction orthogonal to the sheet conveying direction. The respective CISs 100*a* and 100*b* are disposed in the conveying direction in association with the respective ball conveying mechanisms 121*a* and 121*b*.

Figure 3B:
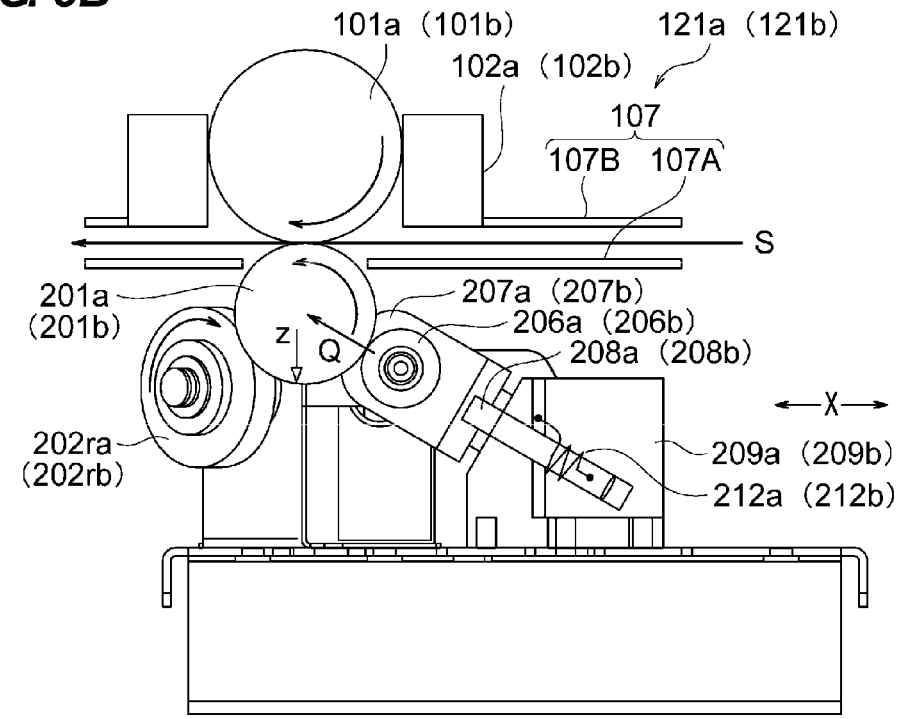

As illustrated in FIG. 3B, the ball conveying mechanisms 121*a* and 121*b* are provided with conveying balls 201*a* and 201*b* serving as spherical conveying rotation members capable of rotating in a desired direction. Moreover, the ball conveying mechanisms 121*a* and 121*b* are also provided with driven balls 101*a* and 101*b* that are disposed above the conveying balls 201*a* and 201*b*, and formed into spherical shapes as driven rotation members that are driven while being made in press-contact with the upper portions of the conveying balls 201*a* and 201*b*. Moreover, the conveying balls 201*a*, 201*b* and the driven balls 101*a*, 101*b* are designed to nip the sheet S so as to be conveyed.

The conveying balls 201*a* and 201*b* are spherical members made from rubber, and disposed in the center in the width direction of the apparatus main body 1A. In this case, although the conveying balls 201*a* and 201*b* are disposed in the center, these are not necessarily required to be disposed in the center, as long as the positions allow the sheet conveying process to be carried out. The driven balls 101*a* and 101*b* are spherical members made from metal. The driven balls 101*a* and 101*b* are movably supported by ball guides 102*a* and 102*b* installed above an upper conveying guide 107A on the upper side of a pair of conveying guides 107 in vertical direction. More specifically, the driven balls 101*a* and 101*b* are movably inserted into holes of the ball guides 102*a* and 102*b* in longitudinal direction. The driven balls 101*a* and 101*b* are pressed with the conveying balls 201*a* and 201*b* by their dead weights. The driven balls 101*a* and 101*b* have spherical shapes; therefore, even when a conveying vector of the conveying balls 201*a* and 201*b* is changed, they are allowed to rotate following the change.

The CISs 100*a* and 100*b* are installed on the upper conveying guide 107A of the pair of conveying guides 107, and disposed on a nip center line extending in the width direction of the conveying balls 201*a*, 201*b* and the driven balls 101*a*, 101*b*. Although the CISs 100*a* and 100*b* are preferably disposed on the nip line, they are not limited by this structure. The pair of conveying guides 107 are plated into black color, and the CISs 100*a* and 100*b* detect the side end positions of the sheet S by detecting a border of differences in brightness between the sheet S and the pair of conveying guides 107.

Figure 4A:
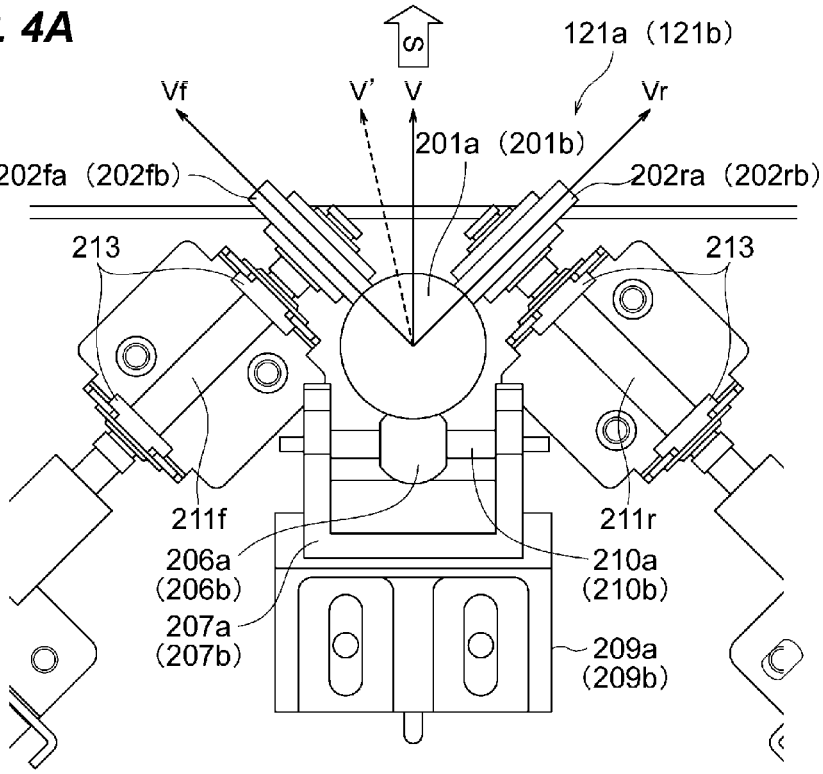
FIGS. 4A and 4B are views that illustrate a schematic configuration of a ball conveying mechanism.

As illustrated in FIG. 4A, the ball conveying mechanism 121*a* is provided with two driving rollers 202*fa* and 202*ra* that are disposed below the conveying ball 201*a*, and rotation-drive the conveying ball 201*a*, while being pressed with the lower portion of the conveying ball 201*a*. Moreover, the ball conveying mechanism 121*a* is provided with a driven roller 206*a* that is driven to rotate, while being pressed with the lower portion of the conveying ball 201*a*. The conveying ball 201*a* is supported by the two driving rollers 202*fa* and 202*ra* and the driven roller 206*a* at three points from below. In the same manner, the conveying ball 201*b* is provided with two driving rollers 202*fb* and 202*rb* and a driven roller 206*b* so that the conveying ball 201*b* is supported by these at three points from below. When in FIG. 3B, the sheet S is conveyed in an arrow direction, the driving rollers 202*ra* and 202*rb* are rotated clockwise, while the conveying balls 201*a* and 201*b* are rotated anti-clockwise. The driving rollers 202*fa* and 202*fb*, which are not illustrated in the FIG. because it is a cross-sectional view, are also allowed to rotate clockwise when viewed from the front side.

Moreover, the ball conveying mechanisms 121*a* and 121*b* include driven roller supporting bases 207*a* and 207*b* that support the driven rollers 206*a* and 206*b* so as to rotate thereon, and base plates 209*a* and 209*b* that support the driven roller supporting bases 207*a* and 207*b*. The base plates 209*a* and 209*b* support the driven roller supporting bases 207*a* and

207*b* so as to pivot around an axial line Q that extends toward the center of the conveying balls 201*a* and 201*b* so that the driven rollers 206*a* and 206*b* move to follow the rotation directions of the conveying balls 201*a* and 201*b*. More specifically, the driven rollers 206*a* and 206*b* are supported on shafts 210*a* and 210*b* so as to freely rotate thereon, and the shafts 210*a* and 210*b* are supported on the driven roller supporting bases 207*a* and 207*b*. Shafts 208*a* and 208*b* that are in parallel with the axial line Q extending toward the center of the conveying balls 201*a* and 201*b* are secured to the driven roller supporting bases 207*a* and 207*b*. With the shafts 208*a* and 208*b* being pivotably supported by the base plates 209*a* and 209*b*, the driven rollers 206*a* and 206*b* are allowed to swing centered on the conveying balls 201*a* and 201*b*. Moreover, one end of each of the crinkle springs 212*a* and 212*b* is secured to each of the shafts 208*a* and 208*b*, and the other end of each of the crinkle springs 212*a* and 212*b* is secured to each of the base plates 209*a* and 209*b* so that in the initial state, the rotation directions of the driven rollers 206*a* and 206*b* are set to be in parallel with the conveying direction.

The circumferential surface of each of the driving rollers 202*fa*, 202*ra* and driving rollers 202*fb* and 202*rb* is made from rubber. The driven rollers 206*a* and 206*b* are rollers made from resin that has a good sliding property. The conveying ball 201*a* is pushed downward by its dead-weight and the gravity of the driven ball 101*a*, and made in press-contact with the two driving rollers 202*fa*, 202*ra* and the driven roller 206*a*. Therefore, the rotary forces of the driving rollers 202*fa* and 202*ra* are transmitted to the conveying ball 201*a* by frictional force so that the conveying ball 201*a* is driven to rotate. In the same manner, the conveying ball 201*b* is pushed downward by its dead-weight and the gravity of the driven ball 101*b*, and pressed with the two driving rollers 202*fb*, 202*rb* and the driven roller 206*b*. Therefore, the rotary forces of the driving rollers 202*fb* and 202*rb* are transmitted to the conveying ball 201*b* by frictional force so that the conveying ball 201*b* is driven to rotate.

In this manner, by supporting the conveying ball 201*a* (201*b*) at three points from below, the conveying ball 201*a* (102*b*) can be effectively pressed with the two driving rollers 202*fa*, 202*ra* (202*fb*, 202*rb*). Therefore, the rotary forces of the driving rollers 202*fa* and 202*ra* (202*fb*, 202*rb*) can be effectively transmitted to the conveying ball 201*a* (201*b*) so that the conveying ball 201*a* (201*b*) can be rotated in a stable manner. Moreover, the gravity of the conveying ball 201*a* (201*b*) to be applied to the two driving rollers 202*fa* and 202*ra* (202*fb* and 202*rb*) and the driven roller 206*a* (206*b*) hardly varies. Therefore, it can reduce variations in frictional force between the two driving rollers 202*fa*, 202*ra* (202*fb*, 202*rb*), as well as the driven roller 206*a* (206*b*), and the conveying ball 201*a* (201*b*). As described above, it can stably convey the sheet in a desired direction at a desired conveying speed, with the rotating speed and rotation direction of the conveying ball 201*a* (201*b*) being stably maintained. Therefore, the posture of the sheet can be corrected with high precision. Moreover, since no additional motor is required to press the driving rollers 202*fa*, 202*ra* (202*fb*, 202*rb*) with the conveying ball 201*a* (201*b*), a simple structure is achieved and the apparatus can be miniaturized with low costs.

As illustrated in FIG. 4A, the driving rollers 202*fa*, 202*ra* are disposed on the downstream side of the conveying ball 201*a* in the sheet conveying direction, and the driven roller 206*a* is disposed on the upstream side of the conveying ball 201*a* in the sheet conveying direction. More specifically, the two driving rollers 202*fa* and 202*ra* are disposed symmetrically with each other laterally relative to the conveying direction around the conveying ball 201*a*. In the present embodiment, the driving rollers 202*fa* and 202*ra* are placed on the downstream side of the conveying ball 201*a* in the conveying direction, and disposed symmetrically with each other with an angle of 45° from the center of the conveying ball 201*a* relative to the conveying direction. Moreover, the driven roller 206*a* is disposed on an axial line extending from the center of the conveying ball 201*a* in the conveying direction, on the upstream side of the conveying ball 201*a* in the conveying direction. In the same manner, the driving rollers 202*fb* and 202*rb* are placed on the downstream side of the conveying ball 201*b* in the conveying direction, and disposed symmetrically with each other with an angle of 45° from the center of the conveying ball 201*b* relative to the conveying direction. Moreover, the driven roller 206*b* is disposed on an axial line extending from the center of the conveying ball 201*b* in the conveying direction, on the upstream side of the conveying ball 201*b* in the conveying direction. Additionally, in the present embodiment, the driving rollers 202*fa*, 202*ra* (202*fb*, 202*rb*) are disposed symmetrically with an angle of 45° on the downstream side of the conveying ball 201*a* (201*b*); however, the angle is not necessarily required to be set to 45°. The layout angle of the driving rollers 202*fa*, 202*ra* (202*fb*, 202*rb*) may be set according to the maximum required speed applied to make a movement in the direction orthogonal to the conveying direction, and in view of supporting at three points, the angle may be set within a range from 30° to 60°.

By arranging the driving rollers 202*fa* and 202*ra* on the downstream side of the conveying ball 201*a* in this manner, a force is applied to the conveying ball 201*a* downward (in a Z-direction indicated by an arrow in FIG. 3B) when the driving roller 202*fa* and 202*ra* are driven to rotate. With this arrangement, a force can be applied to the conveying ball 201*a* in a direction to press with the driving rollers 202*fa*, 202*ra* and driven roller 206*a*. Therefore, the conveying ball 201*a* is prevented from being raised so that the driving rollers 202*fa*, 202*ra*, the driven roller 206*a* and the conveying ball 201*a* are mutually pressed with one another; thus, the rotation of the conveying ball 201*a* can be stabilized. In the same manner, a force is also applied to the conveying ball 201*b* in a direction to make it in press-contact with the driving rollers 202*fb*, 202*rb* and driven roller 206*b*. Therefore, the conveying ball 201*b* is prevented from being raised so that the driving rollers 202*fb*, 202*rb*, the driven roller 206*b* and the conveying ball 201*b* are mutually made in tight-contact with one another; thus, the rotation of the conveying ball 201*b* can be stabilized.

The ball conveying mechanism 121*a* is provided with two ball driving motors 204*fa* and 204*ra* (FIG. 3A) serving as two driving portions that respectively drive the driving rollers 202*fa* and 202*ra* to rotate. Moreover, the ball conveying mechanism 121*b* is provided with two ball driving motors 204*fb* and 204*rb* (FIG. 3A) serving as two driving portions that respectively drive the driving rollers 202*fb* and 202*rb* to rotate. The driving rollers 202*fa* and 202*ra* are respectively coupled to the ball driving motors 204*fa* and 204*ra* through shafts 211*f* and 211*r*, and the shafts 211*f* and 211*r* are rotatably supported by a bearing 113. In the same manner, the driving rollers 202*fb* and 202*rb* are respectively coupled to the ball driving motors 204*fb* and 204*rb* through shafts 211*f* and 211*r*, and the shafts 211*f* and 211*r* are rotatably supported by the bearing 113. The ball driving motors 204*fa*, 204*ra*, 204*fb* and 204*rb* are stepping motors which can set speeds desirably.

Figure 4B:
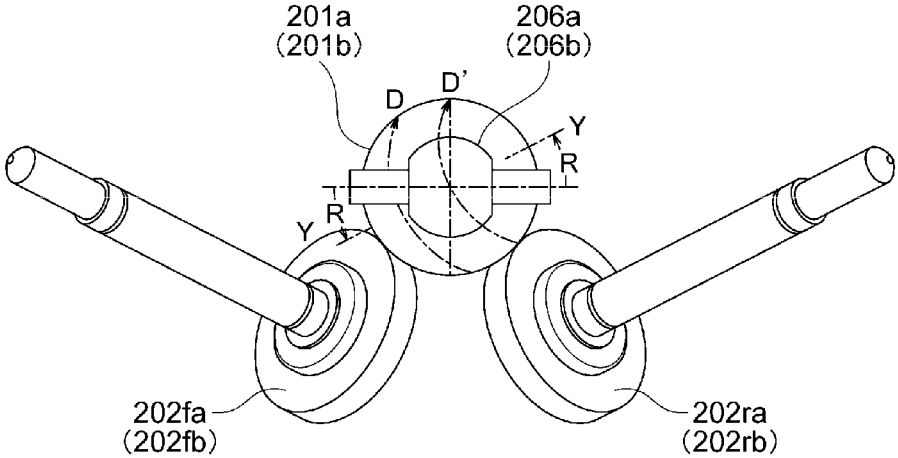

FIG. 4B illustrates the driven roller 206*a* (206*b*) and the conveying ball 201*a* (201*b*) viewed in an axial line Q direction; however, the rotation direction of the conveying ball

201*a* (201*b*) is undetermined. For example, in the case when the equator rotates in an arrow D direction indicated by a chain line around a Y-Y' axis, the orbit on the driven roller 206*a* (206*b*) is directed to an arrow D' direction indicated by a two-dot chain line. In the present embodiment, since the driven roller 206*a* (206*b*) is allowed to tilt centered on the shaft 208*a* (208*b*), it is tilted in an arrow R direction following the rotation direction of the conveying ball 201*a* (201*b*) so that no rotation resistance is given to the conveying ball 201*a* (201*b*).

However, since the conveying ball 201*a* (201*b*) is supported at three points by the driving roller 202*fa*, 202*ra* (202*fb*, 202*rb*) and the driven roller 206*a* (206*b*), the height of the conveying ball 201*a* deviates depending on the respective positions and common difference of the diameter.

Therefore, in the present embodiment, as illustrated in FIG. 3B, the position of the driven roller 206*a* (206*b*) can be adjusted in a contacting/separating direction relative to the two driving rollers 202*fa*, 202*ra* (202*fb*, 202*rb*). More specifically, the base plate 209*a* (209*b*) can be adjusted in an arrow X direction in parallel with the conveying direction. By adjusting the position of the base plate 209*a* (209*b*) so as to adjust the position of the driven roller 206*a* (206*b*), the height adjustment of the conveying ball 201*a* (201*b*) can be executed. Moreover, the center position adjustment relative to the driven ball 101*a* (101*b*) is carried out by adjusting the position of the ball guide 102*a* (102*b*).

Figure 5:
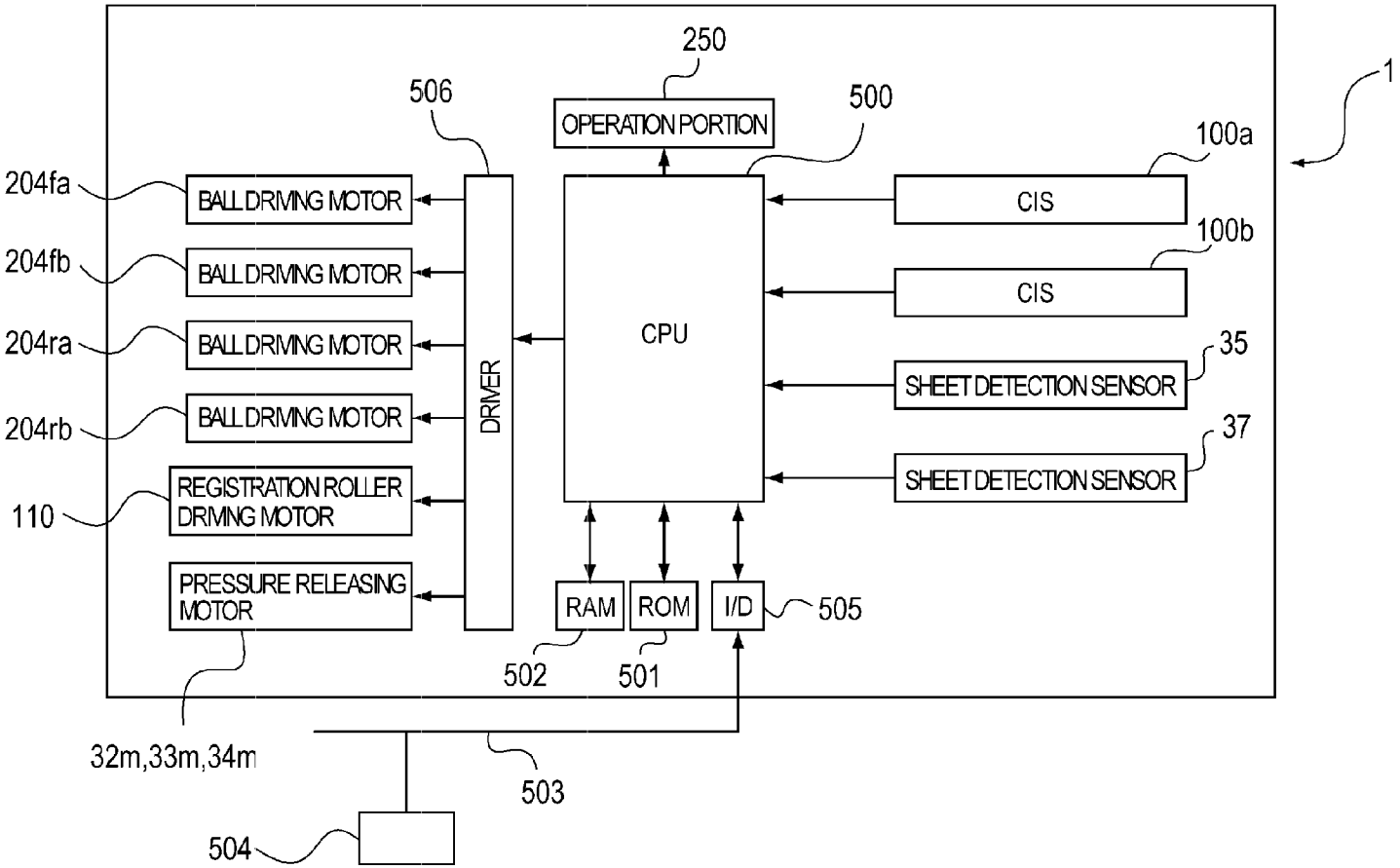
FIG. 5 is a block diagram that illustrates a CPU of the image forming apparatus and a control object of the CPU.

As illustrated in FIG. 5, the image forming apparatus 1 is provided with a CPU 500 serving as a control portion used for controlling the entire apparatus, a ROM 501 in which control programs are stored, and a RAM 502 that provides a working area. Moreover, the image forming apparatus 1 is also provided with an I/O 505 connected to a computer 504 through the network 503. Furthermore, in addition to the above-mentioned ball driving motors 204*fa*, 204*fb*, 204*ra* and 204*rb*, and the pressure releasing motors 32*m*, 33*m* and 34*m*, the image forming apparatus 1 is provided with a registration roller driving motor 110 that drives to rotate the registration driving roller 36*a*. Based on pieces of information of the respective sensors, input information by the operation portion 250, input information from the computer 504 through the I/O 505, the CPU 500 outputs instructions to the driver 506 to control the respective motors. That is, the CPU 500 operates the ball driving motors 204*fa*, 204*fb*, 204*ra* and 204*rb* so as to allow the sheet S to be diagonally conveyed at a diagonal angle and a diagonal speed that have been determined so that the conveying balls 201*a* and 201*b* are rotated.

Figure 6:
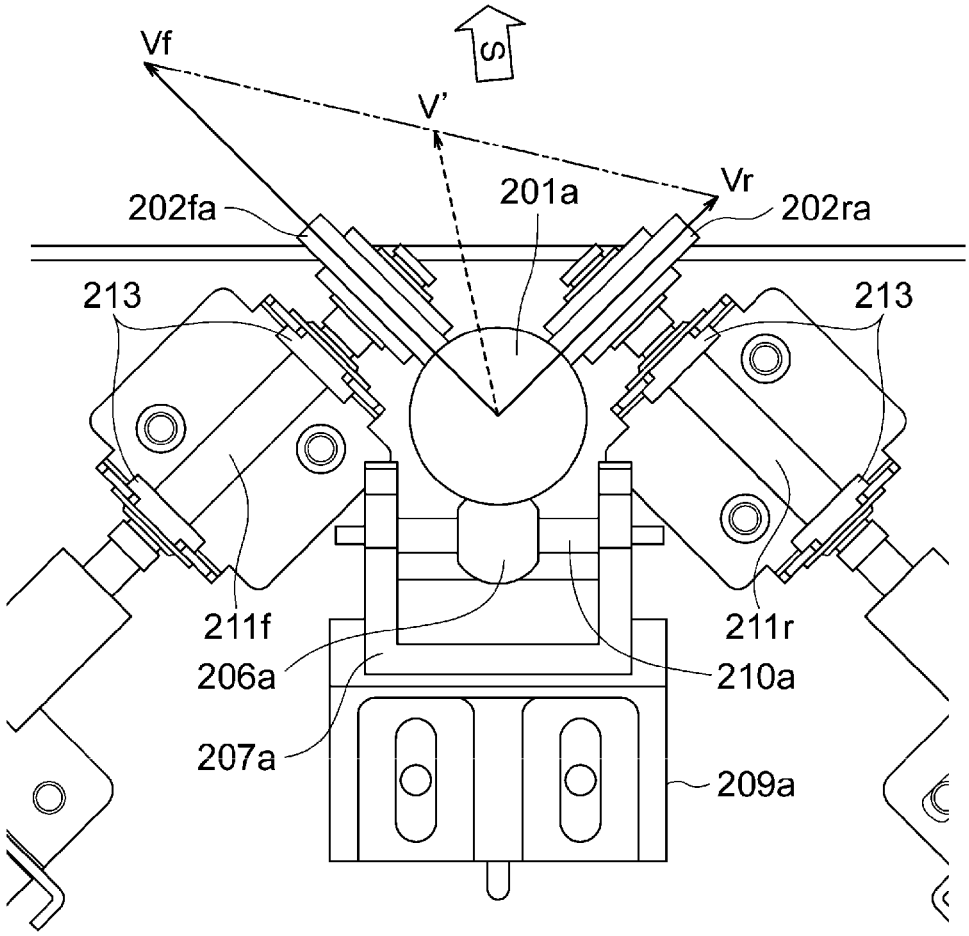
FIG. 6 is a view that illustrates a velocity vector of the ball conveying mechanism.

The description of operations of the ball conveying mechanisms 121*a* and 121*b* of the sheet posture correcting portion 301 will be made in the following. Since the operations of the ball conveying mechanisms 121*a* and 121*b* are the same, the description of the operations is given to only one of the ball conveying mechanisms 121*a*. In FIG. 4A, the driving rollers 202*fa* and 202*ra* are disposed symmetrically with each other in the conveying direction. In the case when the conveying direction of the sheet S is indicated by a void arrow, supposing that the vector of the conveying velocity of the conveying ball 201 is indicated by V, the sheet conveying velocity vector varies depending on a difference in velocities between the velocity Vf by the driving operation of the driving roller 202*fa* and the velocity Vr by the driving operation of the driving roller 202*ra*. In FIG. 4A, since Vf=Vr is satisfied, the sheet S is conveyed in the conveying direction toward the image forming section 90. Next, in the case when the sheet S is diagonally conveyed, upon directing the sheet S to the front side, for example, as illustrated in FIG. 6, the velocity settings of the driving rollers 202*fa* and 202*ra* are made so as to satisfy Vf>Vr, in order to set the conveying velocity vector to V'. In this manner, the rotating velocities of the driving rollers 202*fa* and 202*ra* by the ball driving motors 204*fa* and 204*ra* are adjusted so that the rotation direction and rotating velocity of the conveying ball 201*a* are set. For example, when Vr=0 (stoppage of the ball driving motor 204*ra*) holds, the sheet can be conveyed toward the arrow Vf side at the maximum angle of 45°. The driving rollers 202*fa* and 202*ra* are not particularly required to be disposed symmetrically, and in the case when the sheet is directed only to one of the sides, one of the driving rollers may be disposed in parallel with the conveying direction.

Figure 7:
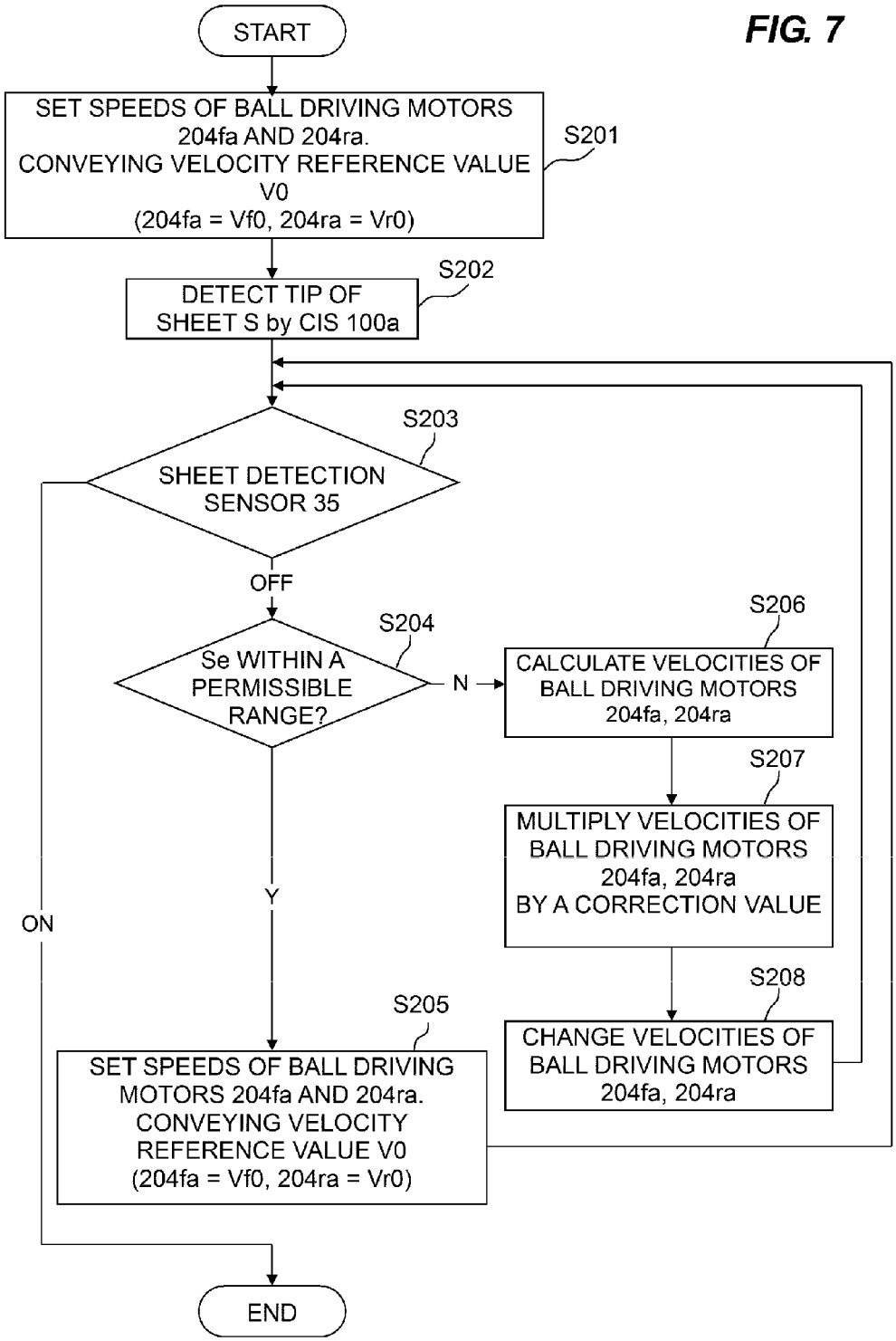
FIG. 7 is a flow chart that illustrates a sheet posture controlling process by the CPU.
Figure 8:
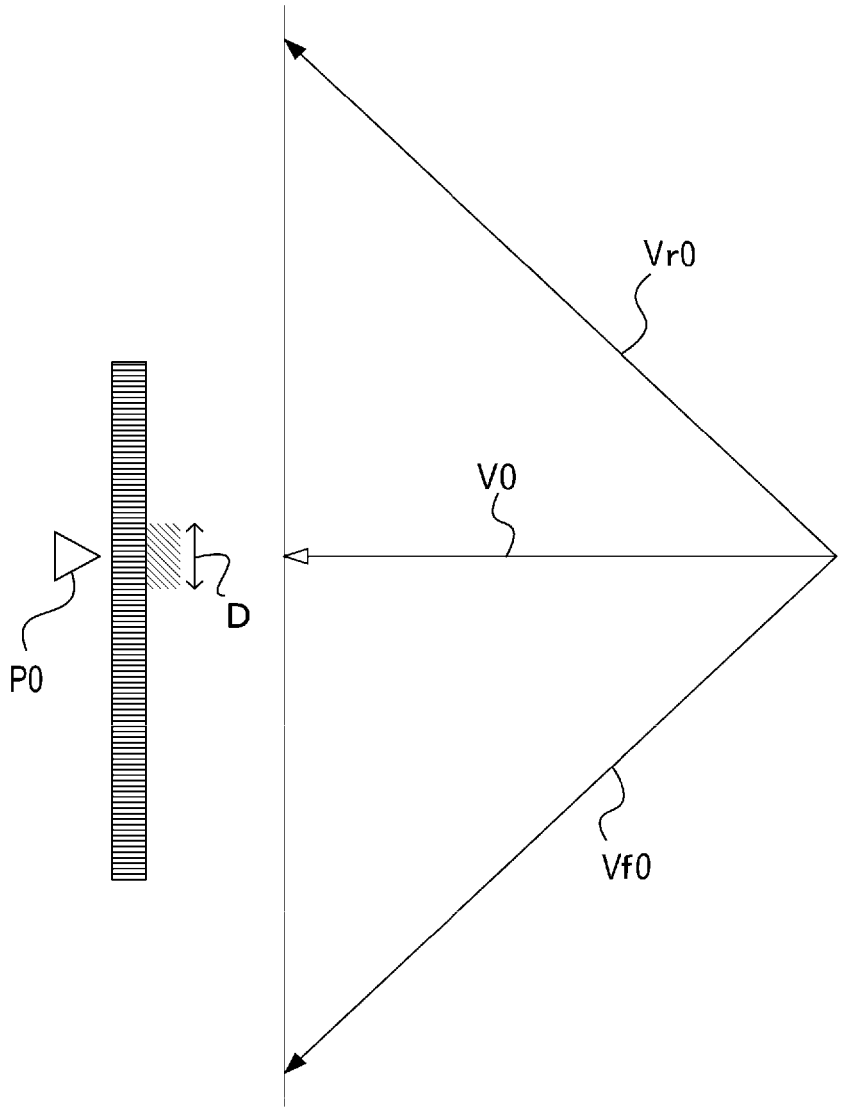
FIG. 8 is a view that illustrates a calculation concept in correcting control.
Figure 9:
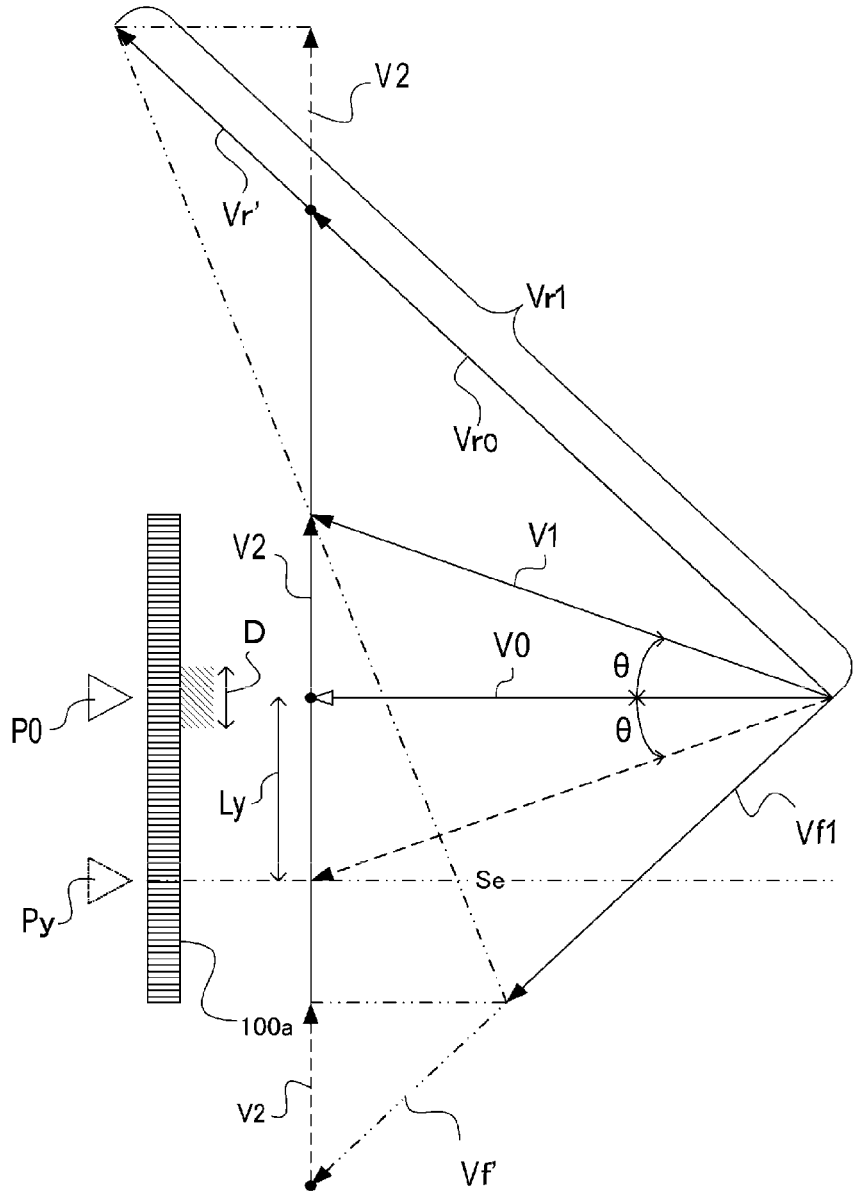
FIG. 9 is a view that illustrates a calculation concept in correcting control.

Next, referring to a flow chart of FIG. 7, the description of a sequence of operations of the sheet posture correcting portion 301 will be made in the following. Since the controlling operations of the ball conveying mechanisms 121*a* and 121*b* are the same, the explanation will be given on only one of the ball conveying mechanisms 121*a*. FIGS. 8 and 9 are drawings that illustrate calculation concepts of the correcting control.

Upon activation of the apparatus main body 1A, the CPU 500 first drives the driving rollers 202*fa* and 202*ra* at rotating velocities of Vf0 and Vr0 by the ball driving motors 204*fa* and 204*ra* so as to set to the rotating velocity of the conveying ball 201*a* to a reference value V0 (S201). That is, the driving rollers 202*fa* and 202*ra* are rotated at Vf0=Vr0. In the present embodiment, since the driving rollers 202*fa* and 202*ra* are disposed symmetrically in a tilted manner with an angle 45° relative to the conveying direction, in order to set the reference value V0 to the same velocity as that of the image forming velocity, the following equations are satisfied.

$$Vf0=V0/\cos 45°$$

$$Vr0=V0/\cos 45°.$$

With this arrangement, the peripheral velocity of these conveying ball 201*a* that rotates at a reference value V0, that is, the conveying velocity of the sheet S, is the same velocity as the image forming velocity of the image forming section 90.

When the sheet S is conveyed from the upstream side in the conveying direction, the side edge position of the sheet S is detected by the CIS 100*a* so that the CPU 500 determines that the leading end of the sheet S has reached, and starts the posture controlling operations (S202). A sheet detecting sensor for detecting the leading end of the sheet S has reached may be installed separately from the CIS 100*a*. In this case, in the case when carrying out the posture controlling operation, the rollers on the upstream side in the conveying direction nip the sheet S, they serve as resistances to make the posture change of the sheet S difficult; therefore, the pressures of idler rollers 32*a*, 33*a* and 34*a* are released by the pressure releasing motors 32*m*, 33*m* and 34*m*.

Next, the CPU 500 determines whether or not the sheet detection sensor 35, placed right before the registration driving roller 36*a*, has detected the sheet (S203). In the case when the sheet detection sensor 35 has detected the sheet S (S203: ON), the posture controlling operation is completed, while in the case when no detection has been made (S203: OFF), the correcting control is continuously carried out.

Since the sheet S is conveyed in a skewed state or in a deviated state in the position in the width direction, the CPU 500 determines whether or not the position Py of the side edge Se of the sheet S detected by the CIS 100*a* is located within a permissible range D including a target position P0 (S204). The target position P0 of the sheet side edge is a value preliminarily stored in a rewritable non-volatile memory or the like, such as the ROM 501 or an EEPROM. Upon determining that it is within the permissible range D (S204: Yes), the ball driving motors 204*fa* and 204*ra* are returned to the initial state. That is, as illustrated in FIG. 8, the CPU 500 sets the rotating velocities of the ball driving motors 204*fa* and 204*ra* to Vf0 and Vr0, with the rotating velocity of the conveying ball 201*a* being set to V0 (S205). Thus, the sheet S is conveyed at a constant velocity that is the same as the image forming velocity in the conveying direction. Next, the CPU 500 proceeds to the process of S203. That is, even in the case when the side edge Se of the sheet S has once entered the permissible range D of the target position P0, if it exceeds the permissible range D, the correcting control is carried out.

Upon determining that it is not within the permissible range D (S204: No) in S204, the CPU 500 executes the correcting control. As the correcting control, the CPU 500 first calculates the finite difference value Ly between the position Py of the side edge Se detected by the CIS 100*a* and the target position P0. Then, depending on the finite difference value Ly, the CPU 500 alters the skew feeding angle and skew feeding velocity in the skew direction relative to the conveying direction of the sheet S by the ball conveying mechanism 121*a*.

In other words, the CPU 500 calculates the rotating velocity of each of the ball driving motors 204*fa* and 204*ra* (S206), and by multiplying the rotating velocity thus calculated by a correction value (S207), the rotating velocity of each of the ball driving motors 204*fa* and 204*fr* is altered (S208).

Referring to FIG. 9, the following description will give a specific example; first, in S206, a distance of deviation of the position Py of the side edge Se of the sheet S detected by the CIS 100*a* from the target position P0, that is, the finite difference value Ly, is calculated.

In the present embodiment, the CPU 500 carries out a controlling operation so that the velocity component in the conveying direction of the skew feeding velocity of the sheet S by the ball conveying mechanism 121*a* is maintained at a constant velocity. That is, the CPU 500 sets the rotating velocities Vf1 and Vr1 of the ball driving motors 204*fa* and 204*ra* so that the velocity component in the conveying direction of the rotating velocity of the conveying ball 201*a* is set to the reference value V0.

In this case, since an attempt is made to move the sheet S in a direction opposite to the deviation direction, the velocity component (vector component) V2 in the width direction orthogonal to the conveying direction needs to be set in a direction toward the target position P0. The velocity component V2 is determined by a distance Lx in which the correcting control is to be converged.

The correcting operation for the sheet S needs to be converged between the conveying ball 201*b* on the downstream side and the sheet detection sensor 35. In the present embodiment, the convergence distance Lx is set to ½ of the distance between the conveying ball 201*b* and the sheet detection sensor 35 so that at least corrections of two times can be carried out.

With the velocity component in the conveying direction of the conveying ball 201*a* being set to the reference value V0, in order to move the position Py of the side edge Se of the sheet S to the target position P0 within the convergence distance Lx, the velocity component V2 of the conveying ball 201*a* is found by the following arithmetic equation:

$$V2=(Ly/Lx)\times V0.$$

That is, as the finite difference value Ly becomes larger, the CPU 500 makes the velocity component in the width direction of the skew feeding velocity of a steering mechanism 120*a* larger. More specifically, as the finite difference value Ly becomes greater, the CPU 500 makes the velocity component V2 in the width direction of the conveying ball 201*a* greater. By determining the velocity component V2, the skew feeding angle θ of the conveying ball 201*a* is determined as:

$$\theta=\tan-1(V2/V0)=\tan-1(Ly/Lx).$$

Next, since the rotating velocity V1 of the conveying ball 201*a* is determined so as to maintain the velocity component in the conveying direction at the reference value V0, it is calculated by the following arithmetic equation:

$$V1=V0/\cos\theta.$$

In this case, since the conveying direction of the conveying ball 201*a* is determined by a velocity difference between the ball driving motors 204*fa* and 204*ra*, the rotating velocity Vf1 of the ball driving motor 204*fa* needs to be determined by subtracting the velocity Vf' corresponding to the conveying orthogonal velocity component V2 from the rotating velocity Vf0. That is, the following equations hold:

$$\begin{aligned} Vf1 &= Vf0 - Vf' \\ &= Vf0 - V2/\cos 45^\circ \\ &= Vf0 - (Ly/Lx)\times V0/\cos 45^\circ \end{aligned}$$

Moreover, the rotating velocity Vr1 of the ball driving motor 204*ra* needs to be determined by adding the velocity Vr' corresponding to the conveying orthogonal velocity component V2 to the rotating velocity Vr0. That is, the following equations hold:

$$\begin{aligned} Vr1 &= Vr0 + Vr' \\ &= Vr0 + V2/\cos 45^\circ \\ &= Vr0 + (Ly/Lx)\times V0/\cos 45^\circ \end{aligned}$$

Incidentally, when the sheet S is shifted in the opposite direction to that of FIG. 9, the rotating velocity Vf1 of the ball driving motor 204*fa* needs to be determined by adding the velocity Vf' corresponding to the conveying orthogonal velocity component V2 to the rotating velocity Vf0. Moreover, the rotating velocity Vr1 of the ball driving motor 204*ra* needs to be determined by subtracting the velocity Vr' corresponding to the conveying orthogonal velocity component V2 from the rotating velocity Vf0. In this manner, the CPU 500 finds the rotating velocities Vf1 and Vr1 of the ball driving motors 204*fa* and 204*ra* based on the finite difference value Ly.

Because the velocity vector of the conveying ball 201*a* and the velocity vector of driving rollers 202*fa* and 202*ra* are different from each other, the rotation driving operation is carried out, with the conveying ball 201*a* and the driving rollers 202*fa* and 202*ra* being slipped due to its deviated portion. Since the driving efficiency is consequently lowered in some cases, the CPU 500 corrects the rotating velocities Vf1 and Vr1 of the ball driving motors 204*fa* and 204*ra* thus found by using a correction value corresponding to the slip between the driving rollers 202*fa*, 202*ra* and the conveying ball 201*a* in S207. More specifically, the rotating velocities Vf1 and Vr1 of the ball driving motors 204*fa* and 204*ra* thus found are multiplied by the correction value. Thus, the skew feeding velocity and the skew feeding angle of the sheet S are made closer to the target values. The driving efficiency is influenced by a friction coefficient between the conveying ball 201*a* and the driving rollers 202*fa*, 202*ra* and a weight of the driven ball 101*a* (contact pressure between the conveying ball 201*a* and the driving rollers 202*fa*, 202*ra*), as well as the layout of the driving rollers 202*fa*, 202*ra*. Therefore, the correction value is set by using experimental values. Moreover, in order to correct a minute difference in friction coefficients and an outside diameter common difference of the driving rollers 202*fa* and 202*ra*, the ball driving motors 204*fa* and 204*ra* may have a correction value independently. Based on the above-mentioned calculations, the velocities of the ball driving motors 204*fa* and 204*ra* are respectively set.

Figure 10A:
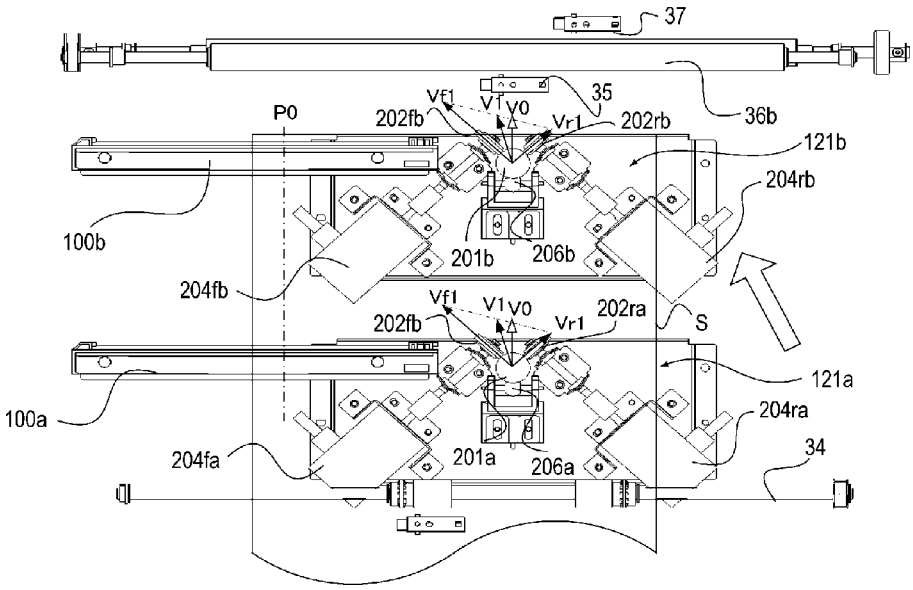
FIGS. 10A and 10B are plan views that illustrate a state of a sheet posture correcting portion upon controlling a sheet posture.

Referring to FIGS. 10A to 12B, the description of a posture controlling state of the sheet S according to the above sequence will be made in the following. FIG. 10A illustrates a state in which the sheet S comes close to the right side relative to the target position P0. In this case, in order to set the velocity vector of the conveying balls 201*a* and 201*b* to V1, by making the velocity Vf1 of the ball driving motors 204*fa* and 204*fb* faster than the velocity Vr1 of the ball driving motors 204*ra* and 204*rb*, the sheet S is allowed to move in a direction of a void arrow. With this arrangement, the sheet S is shifted in the direction of the void arrow so as to allow the position Py of the side edge Se to come closer to the target position P0.

Figure 10B:
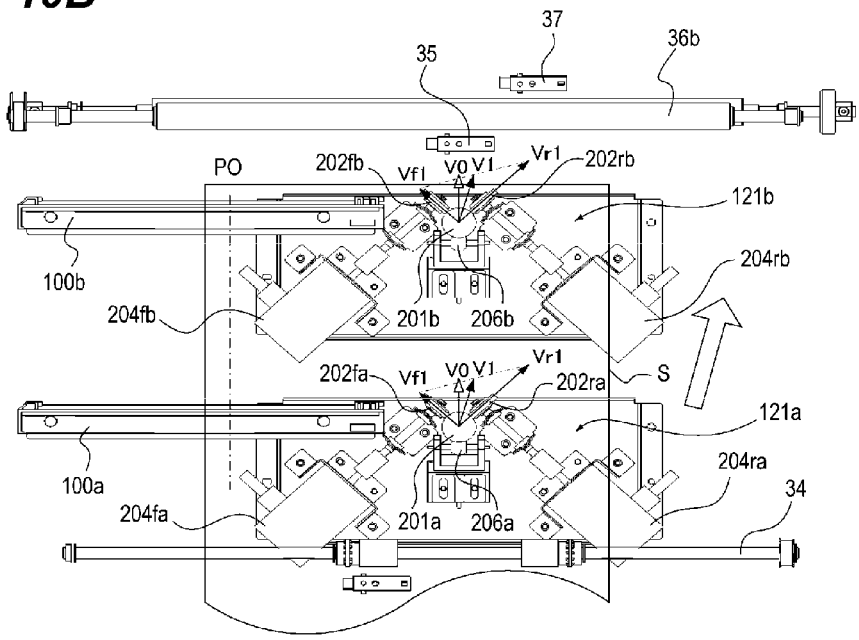

FIG. 10B illustrates a state in which the sheet S comes close to the left side relative to the target position P0. In this case, by making the velocity Vf1 of the ball driving motors 204*fa* and 204*fb* slower than the velocity Vr1 of the ball driving motors 204*ra* and 204*rb*, the sheet S is allowed to move in a direction opposite to the above-mentioned direction. With this arrangement, the sheet S is shifted in the direction of the void arrow so as to allow the position Py of the side edge Se to come closer to the target position P0.

Figure 11A:
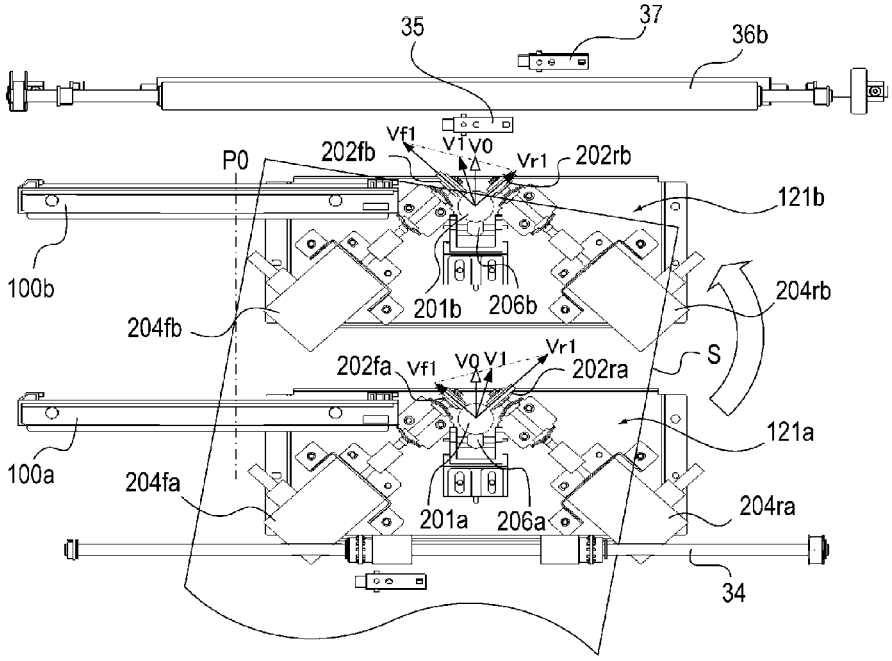
FIGS. 11A and 11B are plan views that illustrate a state of a sheet posture correcting portion upon controlling a sheet posture.

Next, FIG. 11A illustrates a state in which the sheet S is subjected to a skew feeding process. In the CIS 100*b* on the downstream side, since the position Py of the side edge Se of the sheet S deviates to the right direction relative to the target position P0, the velocity Vf1 of the ball driving motor 204*fb* on the downstream side is set faster than the velocity Vr1 of the ball driving motor 204*rb*. In contrast, in the CIS 100*a* on the upstream side, since the position Py of the side edge Se of the sheet S deviates to the left direction relative to the target position P0, the velocity Vf1 of the ball driving motor 204*fa* on the upstream side is set slower than the velocity Vr1 of the ball driving motor 204*ra*. Thus, the conveying ball 201*b* on the downstream side tries to push the sheet S toward the left side, while the conveying ball 201*a* on the upstream side tries to push the sheet S toward the right side. As a result, the sheet S turns around as indicated by a void arrow. Since the velocity component in the conveying direction is kept constant, with the velocity component in the width direction being changed, the sheet S can be turned around smoothly without causing any stress onto the sheet S. Thus, since no warping occurs even in the case of ultra-thin paper lacking of firmness, a posture controlling operation can be carried out with high precision.

Figure 11B:
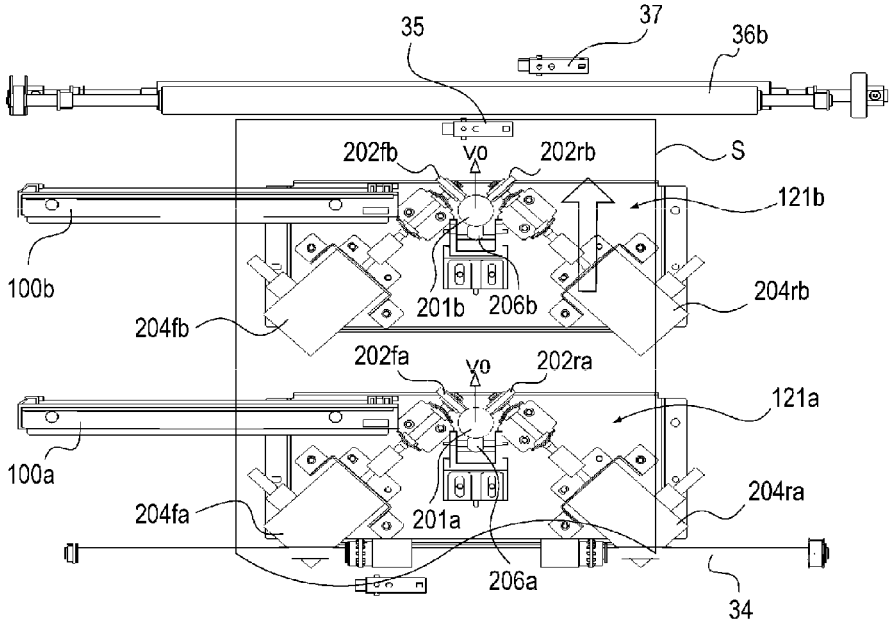

FIG. 11B illustrates a state after completion of the sheet posture control, and upon detection of the sheet S by the sheet detection sensor 35, the CPU 500 sets the skew feeding angle of each of the ball conveying mechanisms 121*a* and 121*b* to 0°. With this arrangement, it is possible to carry out the posture correcting control immediately before the sheet S is nipped by the pair of registration rollers 36*a* and 36*b* that are stable in the conveying operation. Therefore, it is possible to reduce the precision of the posture correcting control of the sheet S from being influenced by the precision of the conveying process of the conveying balls 201*a* and 201*b*. Additionally, since the pair of registration rollers 36*a* and 36*b* are stopped without operations when the sheet S is conveyed thereto, no skew feeding occurs due to an abutment action.

In the present embodiment, the tip positions of the image and the sheet S are adjusted by the acceleration and deceleration of the pair of registration rollers 36*a* and 36*b*; however, by allowing the respective ball conveying mechanisms 121*a* and 121*b* to have this function, the pair of registration rollers may be omitted. In this case, it is possible to carry out the posture correcting control immediately before the sheet S is subjected to an image-forming operation in the image forming section 90.

Figure 12A:
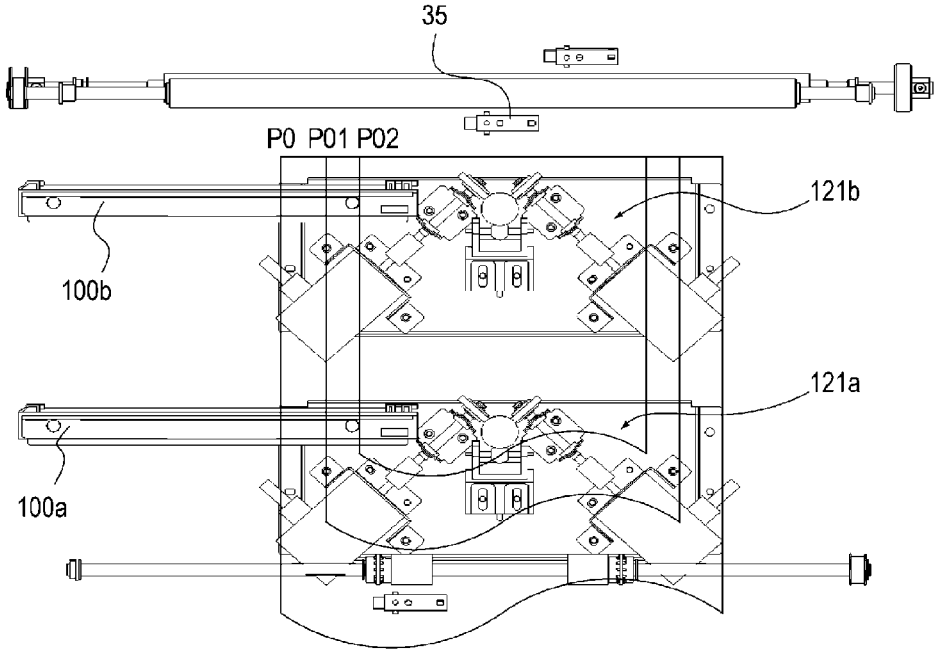
FIGS. 12A and 12B are plan views that illustrate a state of a sheet posture correcting portion upon controlling a sheet posture.

Next, as illustrated in FIG. 12A, in the present embodiment, the sheet S is conveyed on the center basis, and in the case when sheets S of different sizes are conveyed, since the CIS's 100*a* and 100*b* are used, the CPU 500 sets target positions P0, P01 and P02 for the respective sizes. The sheet size information is inputted to the CPU 500 from a personal computer through the operation portion 250, or a network 503. Alternatively, the sheet size information is inputted to the CPU 500 through a sheet size detection portion, not illustrated, attached to the sheet supplying device 1B.

In the case when an alignment between the image forming section 90 side and the registration portion 30 side is shifted, the positions of the image and the sheet tend to be shifted even when the posture controlling operation is carried out correctly. When the adjustment is made by adjusting the position of the registration portion 30 itself to the image, complicated jobs are required since the device should be stopped.

Figure 12B:
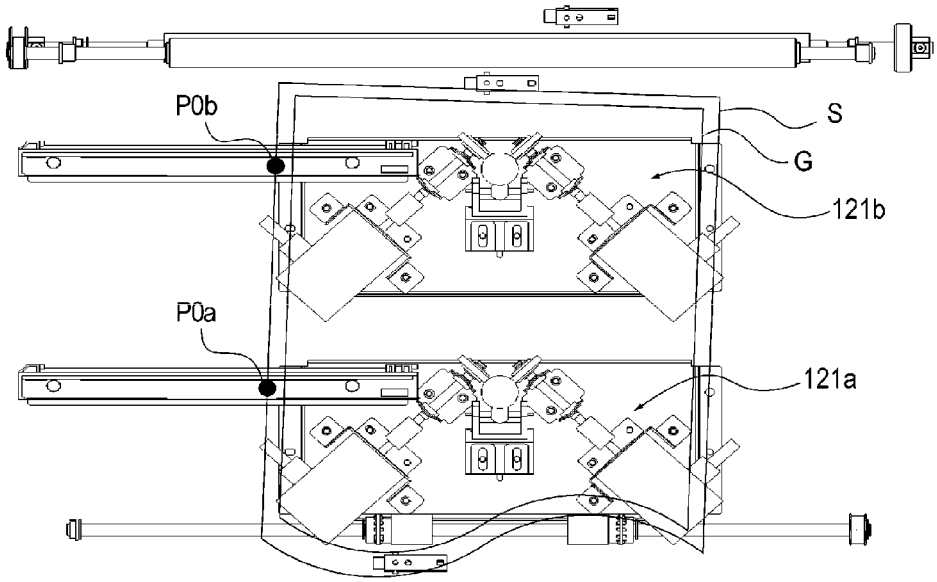

Therefore, in the present embodiment, as illustrated in FIG. 12B, the target positions are respectively set in association with the CIS's 100*a* and 100*b*, and the target positions P0*a* and P0*b* corresponding to the CIS's 100*a* and 100*b* can be altered individually. Moreover, by setting the target position P0*a* on the upstream side and the target position P0*b* on the downstream side, with a deviation corresponding to the alignment shift, the deviation between the sheet S and the image G can be adjusted. As the adjusting job, an adjustment value is inputted from the computer 504 through the operation portion 250 or the network 503. Thus, the job can be carried out easily. Another advantage is that the costs required for installing the adjustment member can be suppressed. Alternatively, by installing a member for detecting the deviation between the image and the sheet in the device, an automatic adjusting process can be carried out.

Moreover, in the case when a thick sheet is conveyed, the target positions P0*a* and P0*b* on the upstream and downstream sides may be set, with a shift being provided therebetween. This structure allows the sheet to be conveyed in a tilted manner so that the tip of the sheet and the secondary transfer inner roller 43 and the secondary transfer outer roller 44 in the secondary transfer portion are no longer kept in parallel with each other. Therefore, it is possible to suppress an abrupt load fluctuation at the time of the transfer nip pinching operation so that it is possible to suppress a change in the velocity of the intermediate transfer belt 40, and to consequently suppress unevenness from occurring. In this case, the image to be transferred needs to be tilted according to the sheet; however, since the amount of tilt of each sheet is constant, neither changes in color tone of a color image due to deviations in dot formations of the respective colors for each sheet occur, nor time consuming calculations for tilting an image are required, so that no reduction in productivity is caused.

As described above, in the present embodiment, the conveying balls 201*a* and 201*b* are changed in their speeds and angles into values found by the aforementioned arithmetic equations. Therefore, the warping of the sheet S is suppressed, and by suppressing a stress from being applied to the sheet S, the sheet skew feeding correction and the positioning of the side edge Se of the sheet S can be carried out. Moreover, even with respect to various kinds of materials including thin paper and the like, an accurate sheet skew feeding correction and an accurate positioning of the side edge Se of the sheet S are available. Furthermore, since the skew feeding angle and skew feeding speed of the ball conveying mechanisms 121*a* and 121*b* are altered by finding the finite difference value Ly, the amount of overshooting of the sheet S in the width direction is made smaller so that the side edge Se of the sheet S can be swiftly made closer to the target position P0. Consequently, the positioning precision of an image onto the sheet S can be improved so that a high-speed sheet conveying process can be achieved and the productivity can be improved.

Moreover, by maintaining the velocity component in the conveying direction of each of the conveying balls 201*a* and 201*b* at the reference value V0, the gap between sheets S is prevented from being deviated so that, even in an attempt to narrow the gap between the sheets S so as to improve the productivity, a stable conveying process can be carried out. Furthermore, a pulling action between the two ball conveying mechanisms 121*a* and 121*b* and warping of the sheet S can be effectively prevented so that a posture controlling operation with high precision can be carried out. Since the velocity component V2 is made larger as the finite difference value Ly becomes larger, the side edge Se of the sheet S can be swiftly made closer to the target position P0.

Figure 13:
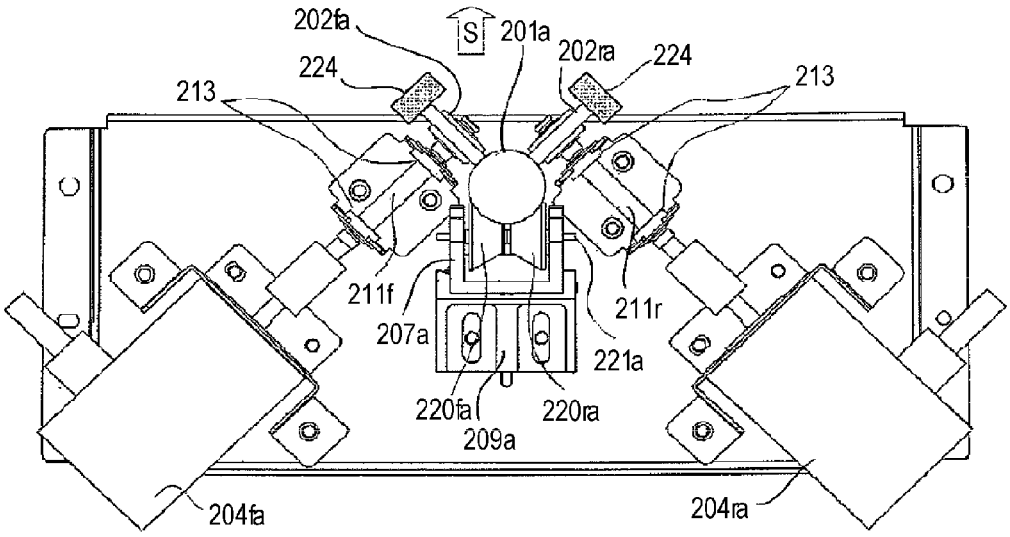
FIG. 13 is a plan view that illustrates an essential portion of a ball conveying mechanism of a sheet conveying apparatus according to another embodiment of the present invention.

The following description will discuss another embodiment of the sheet conveying apparatus of the present invention. FIG. 13 is a plan view that illustrates an essential portion of a ball conveying mechanism of the sheet conveying apparatus of the other embodiment of the present invention, and with respect to the same structures as those of the above embodiment are indicated by the same reference numerals, and the description thereof will be omitted. In FIG. 13, only the ball conveying mechanism on the upstream side is illustrated; however, the ball conveying mechanism on the downstream side has the same structure.

Driven rollers are composed of two frustum members 220*fa* and 220*fb* that are symmetrically disposed relative to the sheet conveying direction around the conveying ball 201*a*, and the two frustum members 220*fa* and 220*fb* are supported so as to rotate independently from each other.

The two frustum members 220*fa* and 220*fb* are independently inserted to a shaft 221*a* so as to rotate therein, and the shaft 221*a* is secured to the driven roller supporting base 207*a*. The driven roller supporting base 207*a* is supported on a base plate 209*a* so as to swing thereon.

With the above-mentioned structure, for example, when the driving roller 202*fa* is allowed to rotate faster than the driving roller 202*ra*, the frustum member 220*ra* is driven to rotate faster than the frustum member 220*fa* so that, by the rotation difference between the two member, the rotation resistance caused by the rotation vector of the conveying ball 201*a* is alleviated.

Moreover, foreign matters, such as paper powder and dusts, adhere to the driving rollers 202*f* and 202*r*. Therefore, in the present embodiment, a cleaning member 224, made from sponge and felt, is installed to abut the peripheral surface of each of the driving rollers 202*fa* and 202*ra*. When the driving rollers 202*fa* and 202*rb* are rotated, foreign matters such as paper powder and dusts, adhered to the peripheral surface of each of the driving rollers 202*f* and 202*r*, are removed. By cleaning the peripheral surface of each of the driving rollers 202*fa* and 202*rb*, the conveying ball 201*a* can be driven in a stable manner.

Figure 14A:
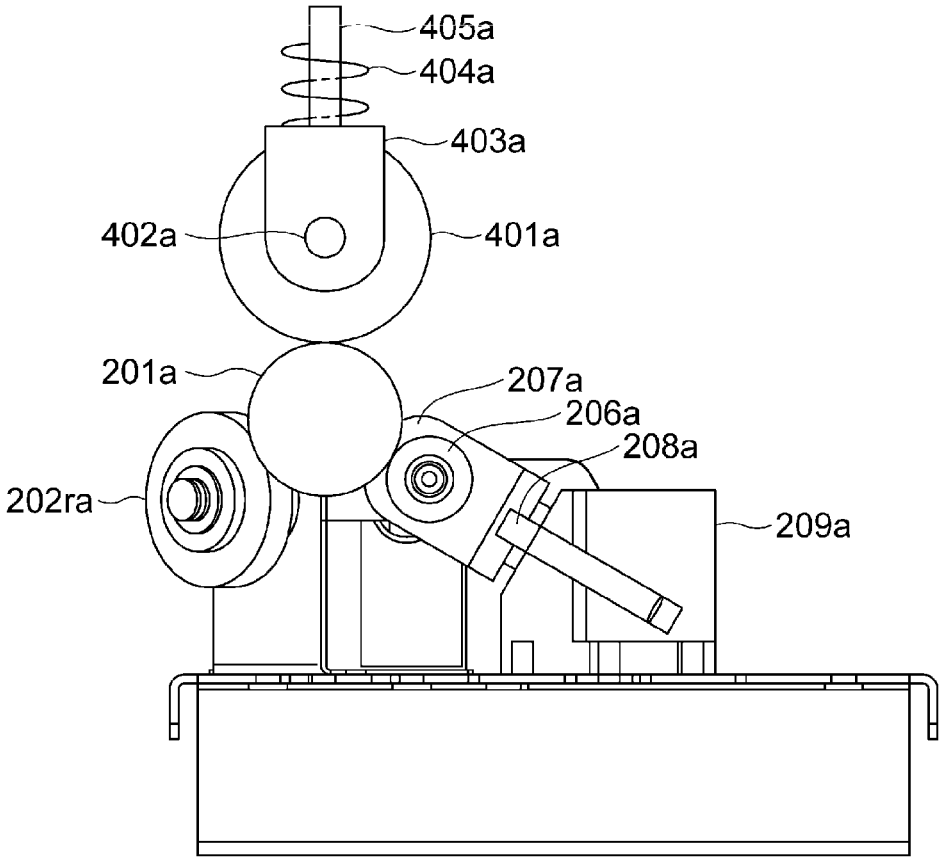
FIGS. 14A and 14B are drawings that illustrate a modified example of a ball conveying mechanism.
Figure 14B:
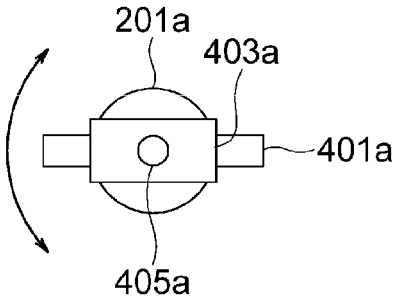

The present invention has been described based on the embodiment; however, the present invention is not intended to be limited by this. The embodiment has been described by exemplifying a structure in which the driven rotating member of each of the ball conveying mechanisms is a driven ball; however, the present invention is not intended to be limited by this. FIG. 14A illustrates a ball conveying mechanism on the upstream side, and as illustrated in FIG. 14A, the driven rotating member of the ball conveying mechanism may be prepared as a driven roller 401*a*. The driven roller 401*a* is rotatably supported on a roller shaft 402*a*. The roller shaft 402*a* is supported by a holder 403*a*. The driven roller 401*a* is pressed by a pressing spring 404*a* toward the conveying ball 201*a*. The driven roller 401*a* is supported on the holder 403*a* so as to swing thereon around a shaft 405*a* secured to the holder 403*a*, as illustrated in FIG. 14B. In FIG. 14, the ball conveying mechanism on the upstream side has been described; however, the ball conveying mechanism on the downstream side may also have the same structure.

Moreover, the above embodiment has been described by exemplifying a structure in which, when the sheet size is the same, the target position P0 of the side edge Se of the sheet S is set to a constant value; however, the present invention is not intended to be limited by this. The target position P0 may be altered for each job in which the CPU 500 carries out an image forming process. With this structure, the border of jobs can be easily recognized, upon stacking sheets S after having been discharged. In general, a mechanism has been known in which a discharge roller or a discharge tray is shifted in the width direction orthogonal to the conveying direction; however, without adding such a mechanism, the same effect can be obtained. In this case, although a controlling process for shifting the writing position of an image formation in response to the amount of movement of the target position P0 is required, this can be easily achieved since the writing position is changed for each of the sheet sizes. Moreover, by altering the sheet S for each of jobs in this manner, even in the case when only the sheets having the same size are conveyed to the rollers, such as a fixing roller, and the intermediate transfer belt, it is possible to prevent those members from being worn by the side edges of sheets to cause lowering of the surface roughness. That is, by gradually moving the target position P0 for each of the sheets, the contact position of the sheet side edge to the rollers is changed so that the durability of the rollers and the like against wearing can be improved. Since the durability against wearing of the rollers and the like is improved, stripes are prevented from being formed on the sheet on which an image is formed. In particular, even when, in a structure in which sheets having small sizes are mainly used, a sheet having a larger size is outputted, it is possible to effectively prevent stripes from being formed on the sheet having a larger size.

In the above embodiment, an explanation has been given by exemplifying a structure in which the present invention is applied to a registration portion of an image forming apparatus using an electrophotographic system; however, the present invention may be applied to another conveying portion.

Moreover, the present invention may be applied to other image forming apparatuses, such as those of an ink-jet system, a thermal transfer system and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-298432, filed Dec. 28, 2009, which is hereby incorporated by reference herein in its entirety.

What is claimed is:

1. A sheet conveying apparatus comprising:

a spherical conveying rotation member driven to rotate in a desired direction;

a driven rotation member disposed above the conveying rotation member so as to be pressed onto an upper portion of the conveying rotation member, and the driven rotation member nips a sheet in cooperation with the conveying rotation member to convey the sheet;

two driving rollers, disposed below the conveying rotation member, that is pressed with the conveying rotation member so as to drive the conveying rotation member to rotate; and a driven roller, disposed below the conveying rotation member, that is pressed with the conveying rotation member to be driven together therewith, wherein the two driving rollers and the driven roller are disposed along an outer periphery of the conveying rotation member and support the conveying rotation member at three points from below.

2. The sheet conveying apparatus according to claim 1, wherein the two driving rollers are disposed on a downstream side of the conveying rotation member in a sheet conveying direction, with the driven roller being disposed on an upstream side of the conveying rotation member in the sheet conveying direction.

3. The sheet conveying apparatus according to claim 1, wherein the two driving rollers are disposed symmetrically relative to the sheet conveying direction around the conveying rotation member.

4. The sheet conveying apparatus according to claim 1, wherein the driven roller comprises two frustum members disposed symmetrically relative to the sheet conveying direction around the conveying rotation member, with the two frustum members being mutually independently supported so as to rotate.

5. The sheet conveying apparatus according to claim 1, further comprising:

a driven roller supporting base that rotatably supports the driven roller; and a base plate that supports the driven roller supporting base so as to pivot around an axial line extending toward the center of the conveying rotation member so that the driven roller is allowed to follow the conveying rotation member in the rotating direction.

6. The sheet conveying apparatus according to claim 1, wherein the driven roller is made adjustable in the position thereof in a direction so as to be made in contact with, or separated from the two driving rollers.

7. The sheet conveying apparatus according to claim 1, further comprising:

a cleaning member that abuts the driving rollers so that peripheral surfaces of the driving rollers are cleaned.

8. The sheet conveying apparatus according to claim 1, further comprising:

two driving portions that respectively drive the driving rollers to rotate, wherein rotating speeds of the respective driving rollers are adjusted by the driving portions so that a rotation direction and a rotating speed of the conveying rotation member are set.

9. An image forming apparatus comprising:

a sheet conveying apparatus that conveys a sheet; and an image forming portion that forms an image on the sheet conveyed by the sheet conveying apparatus, wherein the sheet conveying apparatus comprises:

a spherical conveying rotation member driven to rotate in a desired direction;

a driven rotation member disposed above the conveying rotation member so as to be pressed onto an upper portion of the conveying rotation member, and the driven rotation member nips a sheet in cooperation with the conveying rotation member to convey the sheet;

two driving rollers, disposed below the conveying rotation member, that are pressed with the conveying rotation member so as to drive the conveying rotation member to rotate; and a driven roller, disposed below the conveying rotation member, that is pressed with the conveying rotation member to be driven together therewith, wherein the two driving rollers and the driven roller are disposed along an outer periphery of the conveying rotation member and support the conveying rotation member at three points from below.

10. The image forming apparatus according to claim 9, wherein the two driving rollers are disposed on a downstream side of the conveying rotation member in a sheet conveying direction, with the driven roller being disposed on an upstream side of the conveying rotation member in the sheet conveying direction.

11. The image forming apparatus according to claim 9, wherein the two driving rollers are disposed symmetrically relative to the sheet conveying direction around the conveying rotation member.

12. The image forming apparatus according to claim 9, wherein the driven roller is composed of two frustum members disposed symmetrically relative to the sheet conveying direction around the conveying rotation member, with the two frustum members being mutually independently rotatably supported.

13. The image forming apparatus according to claim 9, further comprising:

a driven roller supporting base that rotatably supports the driven roller; and a base plate that supports the driven roller supporting base so as to pivot around an axial line extending toward the center of the conveying rotation member so that the driven roller is allowed to follow the conveying rotation member in the rotating direction.

14. The image forming apparatus according to claim 9, wherein the driven roller is made adjustable in the position thereof in a direction so as to be made in contact with, or separated from the two driving rollers.

15. The image forming apparatus according to claim 9, further comprising:

a cleaning member that abuts the driving rollers so that peripheral surfaces of the driving rollers are cleaned.

16. The image forming apparatus according to claim 9, further comprising: two driving portions that respectively drive the driving rollers to rotate, wherein rotating speeds of the respective driving rollers are adjusted by the driving portions so that a rotation direction and a rotating speed of the conveying rotation member are set.

* * * * *